US010247480B2

(12) United States Patent
Wallace et al.

(10) Patent No.: US 10,247,480 B2
(45) Date of Patent: Apr. 2, 2019

(54) HIGH TEMPERATURE FURNACE

(71) Applicant: General Electric Company, Schenectady, NY (US)

(72) Inventors: Marcus Nathanial Wallace, Hamilton, OH (US); Roger Irvin Seither, Mason, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/581,246

(22) Filed: Apr. 28, 2017

(65) Prior Publication Data

US 2018/0313609 A1 Nov. 1, 2018

(51) Int. Cl.

| | |
|---|---|
| ***F27D 11/12*** | (2006.01) |
| ***F27B 17/00*** | (2006.01) |
| *F27D 99/00* | (2010.01) |

(52) U.S. Cl.

CPC ..... *F27D 11/12* (2013.01); *F27B 17/0016* (2013.01); *F27B 2017/0091* (2013.01); *F27D 2099/0011* (2013.01)

(58) Field of Classification Search

CPC ... H05B 6/02; H05B 3/06; H05B 3/16; H05B 2203/017; H05B 3/00; B29B 13/024; B29C 2049/0089; F27D 2001/0059; H01L 21/67098; F27B 17/0016

See application file for complete search history.

(56) References Cited

U.S. PATENT DOCUMENTS

| | | | | |
|---|---|---|---|---|
| 2,000,664 | A * | 5/1935 | Hayes | C21D 9/00 432/207 |
| 3,074,704 | A * | 1/1963 | Bela | B23K 28/003 110/195 |
| 3,609,199 | A * | 9/1971 | Krall | B22F 3/003 373/109 |
| 3,902,862 | A | 9/1975 | Moll et al. | |
| 4,066,449 | A | 1/1978 | Havel | |
| 4,441,015 | A * | 4/1984 | Eichelberger | A47J 37/0635 219/401 |
| 4,797,155 | A | 1/1989 | Das | |
| 5,009,704 | A | 4/1991 | Banik | |
| 5,395,464 | A | 3/1995 | Davidson | |
| 5,676,870 | A * | 10/1997 | Wassman | F24C 15/325 126/21 A |

(Continued)

OTHER PUBLICATIONS

Applied Test Systems Product Bulletin, Furnaces Laboratory and Industrial, 2014, pp. 1-36, http://www.atspa.com/furnaces_r2.pdf.

*Primary Examiner* — Gregory A Wilson

(74) *Attorney, Agent, or Firm* — General Electric Company; Kristi Davidson

(57) ABSTRACT

A high temperature furnace includes features that provide for multiple heating zones for heating a specimen extending at least partially through a heating chamber defined by the furnace. In one exemplary aspect, the furnace can include multiple heating elements extending at least partially through the heating chamber. Each heating element can be configured in a rod shape, which allows for multiple heating zone capability, better control over the temperature gradient, reduced current to achieve a desired temperature output, and a streamlined furnace shell.

17 Claims, 14 Drawing Sheets

(56) References Cited

U.S. PATENT DOCUMENTS

| | | | | |
|---|---|---|---|---|
| 5,694,734 | A * | 12/1997 | Cercone | B65H 81/08 52/745.17 |
| 6,905,332 | B1 * | 6/2005 | Neal | A21B 1/24 110/336 |
| 7,854,866 | B2 * | 12/2010 | Atkinson | B29C 35/0277 264/1.32 |
| 8,889,064 | B2 | 11/2014 | Raisson | |
| 9,555,473 | B2 | 1/2017 | Slattery | |
| 2007/0020135 | A1 | 1/2007 | Jackson et al. | |
| 2015/0108107 | A1 * | 4/2015 | Liu | H01L 21/67109 219/396 |
| 2015/0182994 | A1 * | 7/2015 | Zhou | F26B 3/30 427/543 |
| 2016/0172220 | A1 * | 6/2016 | Pan | H01L 21/67115 118/725 |

* cited by examiner

HIGH TEMPERATURE FURNACE

FIELD

The present subject matter is generally related to high temperature furnaces.

BACKGROUND

Generally, there is a need to heat specimens to high temperatures for testing and analytical purposes, among other possible reasons. For instance, during a strain controlled fatigue test, a specimen can be heated to temperatures at or exceeding 2400° F. by a high temperature furnace. In some cases, such as when testing a specimen formed of a Ceramic Matrix Composite (CMC) material, it is desirable to heat the CMC specimen to temperatures at or exceeding 2700° F. It may likewise be desirable to heat other materials having high temperature capability to high temperatures.

Conventional high temperature furnaces used to heat such specimens are typically capable of reaching high temperatures. However, such conventional high temperature furnaces tend to fail when operated at high temperatures during prolonged operating periods, such as e.g., when heating a CMC specimen for the duration of a run-out strain controlled fatigue test. In addition, such conventional high temperature furnaces typically include one or more heating elements that provide a single heating zone for heating the specimen. Thus, there is no opportunity to test how the specimen will react when subjected to multiple heating zones. Furthermore, the single heating zone provided by conventional high temperatures furnaces may not produce an acceptable temperature gradient profile of the test specimen that is within testing specifications.

Moreover, in an attempt to maintain the set point temperature within the heating chamber of such conventional furnaces, large amounts of current are passed through the heating elements, which negatively impacts the energy efficiency of the furnace and disrupts testing instrumentation. Additionally, the heating elements of conventional furnaces are oriented and configured in such a way (e.g., U-shaped heating elements) that they effectively increase the size of the furnace, making the high temperature furnace assembly bulky and more costly.

Therefore, there is a need for improved high temperature furnaces that address at least some of these noted challenges.

BRIEF DESCRIPTION

Aspects and advantages of the invention will be set forth in part in the following description, or may be obvious from the description, or may be learned through practice of the invention.

In one exemplary aspect, the present subject matter is directed to a high temperature furnace. The high temperature furnace defines a vertical direction, a lateral direction, and a transverse direction. The high temperature furnace includes a shell defining a heating chamber. The high temperature furnace also includes a plurality of heating elements each extending at least partially through the heating chamber. The plurality of heating elements include a first top heating element, a first bottom heating element, a second top heating element, and a second bottom heating element. The first top heating element is spaced apart from the second top heating element along the lateral direction. The first bottom heating element is spaced apart from the second bottom heating element along the lateral direction. The first and second top heating elements are spaced apart from the first and second bottom heating elements along the vertical direction. During operation of the high temperature furnace, the heating elements define at least two heating zones, including a first heating zone and a second heating zone.

In another exemplary aspect, the present subject matter is directed to a high temperature furnace. The high temperature furnace defines a vertical direction, a lateral direction, and a transverse direction. The high temperature furnace includes a shell defining a heating chamber. The heating chamber has a length extending along the transverse direction between a front portion and a back portion. The high temperature furnace further includes a plurality of heating elements each being rod-shaped and extending at least partially through the heating chamber along the transverse direction, each heating element having a transverse length. The transverse length is greater than the length of the shell. The plurality of heating elements including a first top heating element, a first bottom heating element, a second top heating element, and a second bottom heating element, the first top heating element spaced apart from the second top heating element along the lateral direction, the first bottom heating element spaced apart from the second bottom heating element along the lateral direction, and the first and second top heating elements spaced apart from the first and second bottom heating elements along the vertical direction. During operation of the high temperature furnace, the heating elements define at least two heating zones, including a first heating zone and a second heating zone.

In yet another exemplary aspect, the present subject matter is directed to a high temperature furnace. The high temperature furnace defines a vertical direction, a lateral direction, and a transverse direction. The high temperature furnace includes a shell defining a heating chamber. The high temperature furnace further includes a plurality of heating elements each being rod-shaped and extending at least partially through the heating chamber along the transverse direction. During operation of the high temperature furnace, the heating elements define at least two heating zones, including a first heating zone and a second heating zone.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
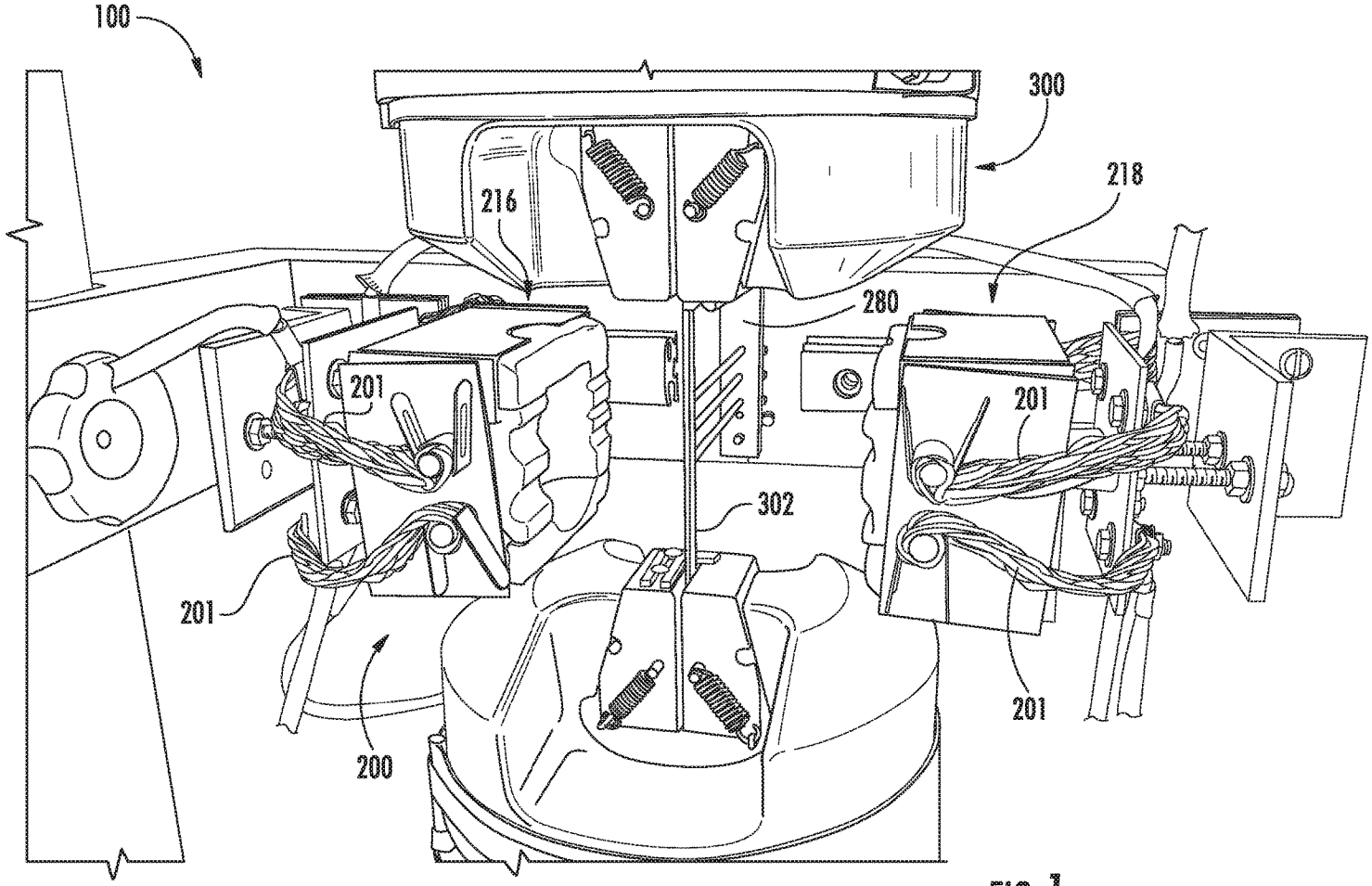
FIG. 1 provides a front, perspective view of an exemplary furnace assembly having an exemplary furnace configured to heat an exemplary specimen according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The present subject matter is directed to a high temperature furnace. In one exemplary aspect, the high temperature furnace includes features that provide for multiple heating zones for heating a specimen extending at least partially through a heating chamber defined by the furnace. In this way, better control over the thermal gradient can be achieved and the current required to provide the desired heat output can be reduced. As a result, energy consumption can be reduced thereby improving the energy efficiency of the furnace. In addition, noise created by excessive current flow can be reduced thereby improving the accuracy of testing instrumentation and testing results. In particular, in one exemplary aspect, the furnace can include multiple heating elements each configured in a rod shape. The rod-shaped heating elements can be configured such that the heating elements can heat the specimen extending through the heating chamber utilizing multiple heating zones. The rod-shaped heating elements also provide for a less bulky furnace configuration. Stated alternatively, due to the straight or relatively straight rod-shaped heating elements, the shell of furnace can be streamlined, reducing the profile, weight, and cost of the furnace. Reducing the size of the furnace may be especially advantageous where the high temperature furnace is positioned within a laboratory or testing facility with limited space. These and other features, aspects, and advantages of the present subject matter will be appreciated with reference to the following description and appended claims.

Turning now to the drawings, FIG. 1 provides a front, perspective view of an exemplary furnace assembly 100 having an exemplary furnace 200 configured to heat a specimen 302 accordingly to an exemplary embodiment of the present disclosure. In particular, furnace 200 of furnace assembly 100 is configured to heat CMC specimen 302 undergoing a strain controlled fatigue test utilizing a testing machine 300. That is, while specimen 302 undergoes testing, the two compartments of furnace 200 can be moved together toward specimen 302 and can provide heat thereto. Furnace 200 can be used to heat other high temperature capability materials undergoing other types of tests as well. For this embodiment, furnace 200 can be used to heat specimen 302 to temperatures equal to or exceeding 2400° F., as well as temperatures equal to or exceeding 2700° F. for prolonged operating periods, such as a period in which a CMC component can undergo fatigue testing. Furnace 200 can be in electrical communication with a power source to provide power thereto. Furnace 200 can be in electrical communication with the power source in any suitable manner. For example, as shown in FIG. 1, the power source can be in electrical communication with furnace 200 via cables 201.

Figure 2:
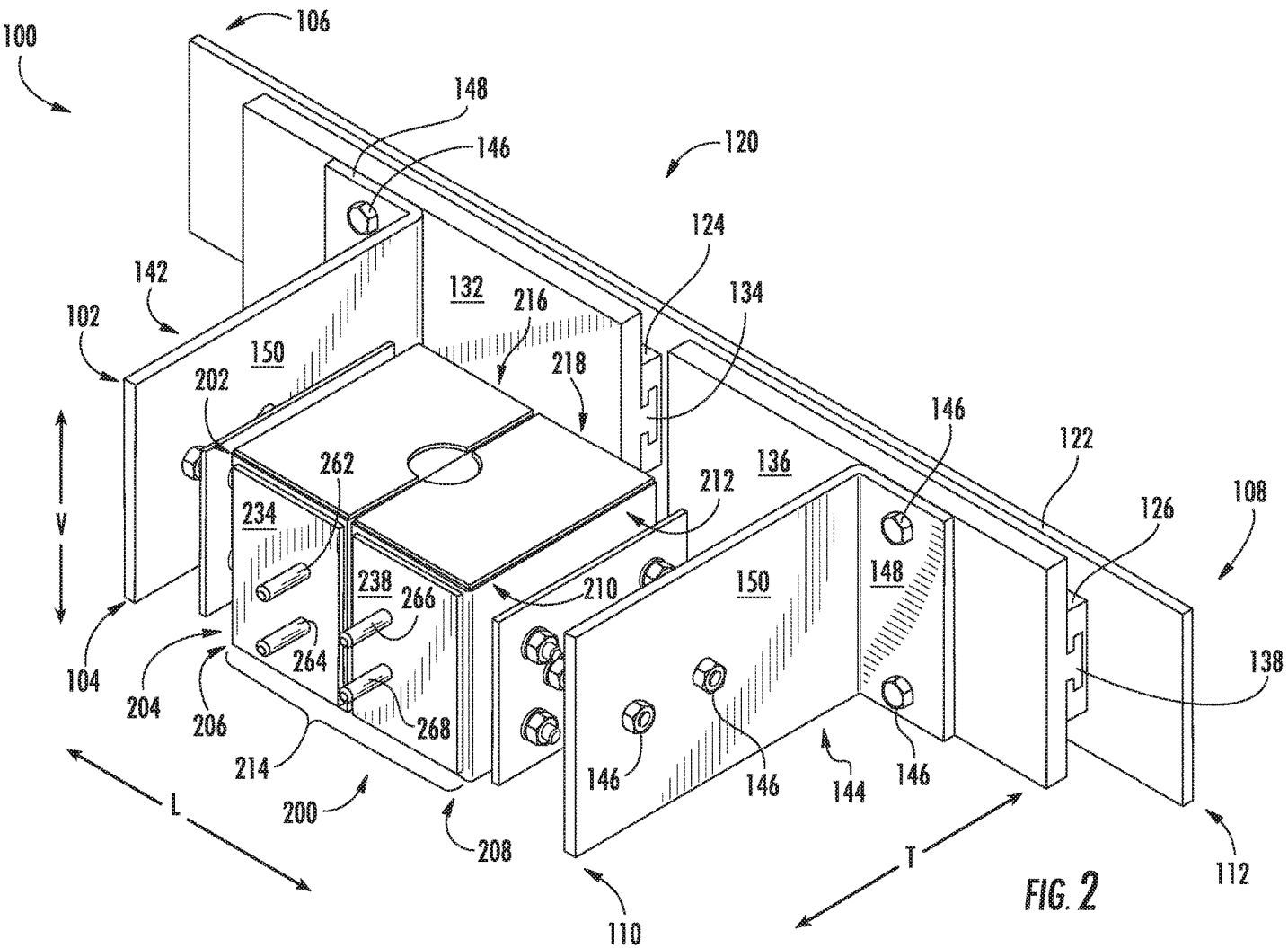
FIG. 2 provides a front, perspective view of an exemplary furnace assembly with furnace shell compartments of an exemplary furnace shown in a closed position according to an exemplary embodiment of the present disclosure.
Figure 3:
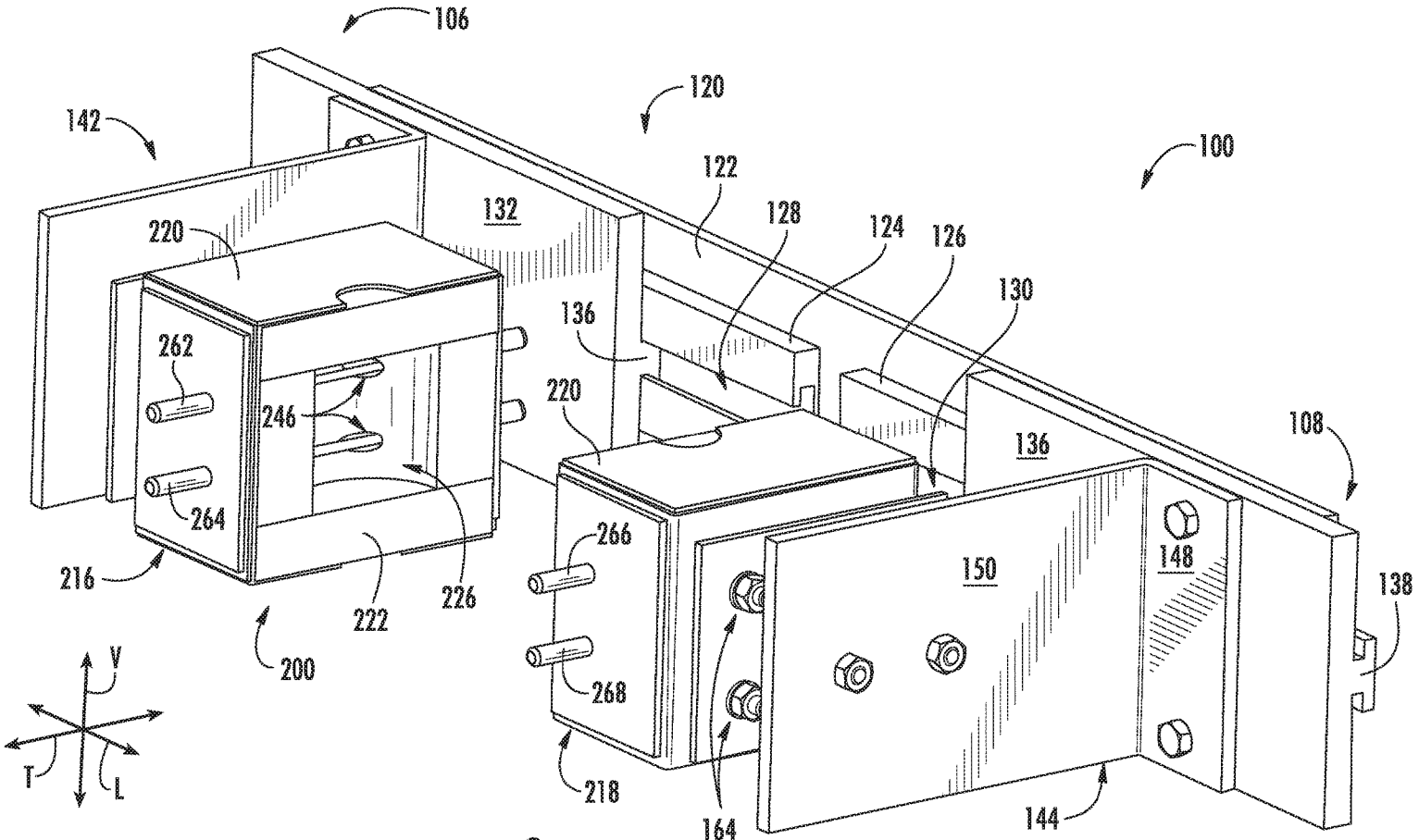
FIG. 3 provides a front, perspective view of the exemplary furnace assembly of FIG. 2 with the furnace shell compartments of the furnace shown in an open position.
Figure 4:
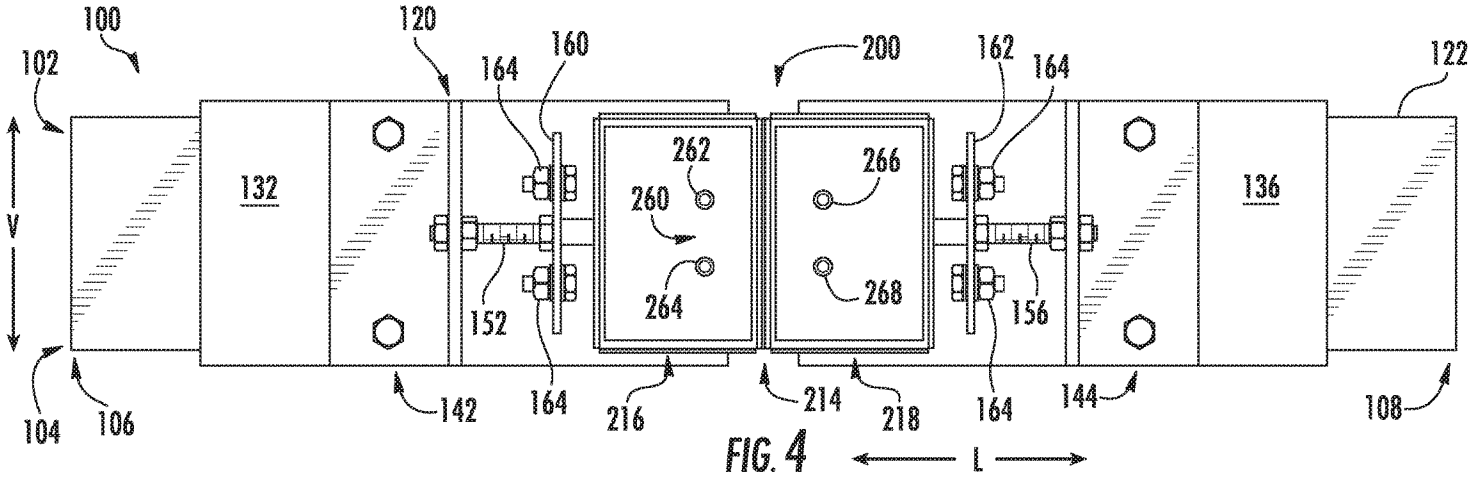
FIG. 4 provides a front view of the furnace assembly of FIG. 2 with the furnace shell compartments of the furnace shown in a closed position.
Figure 5:
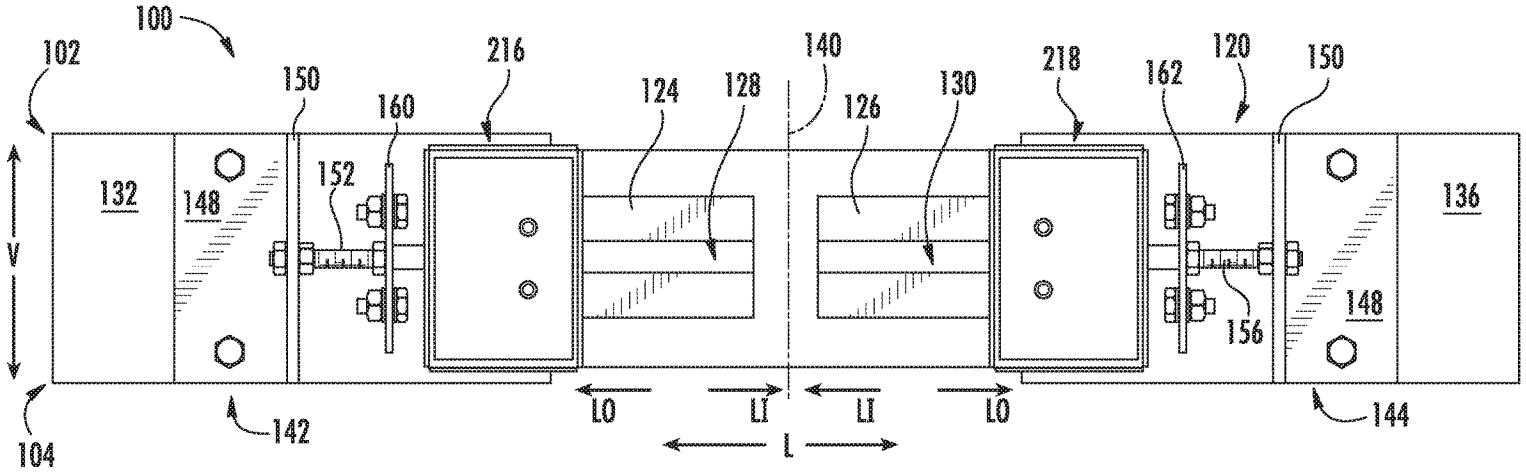
FIG. 5 provides a front perspective view of the furnace assembly of FIG. 2 with the furnace shell compartments of the furnace shown in an open position.
Figure 6:
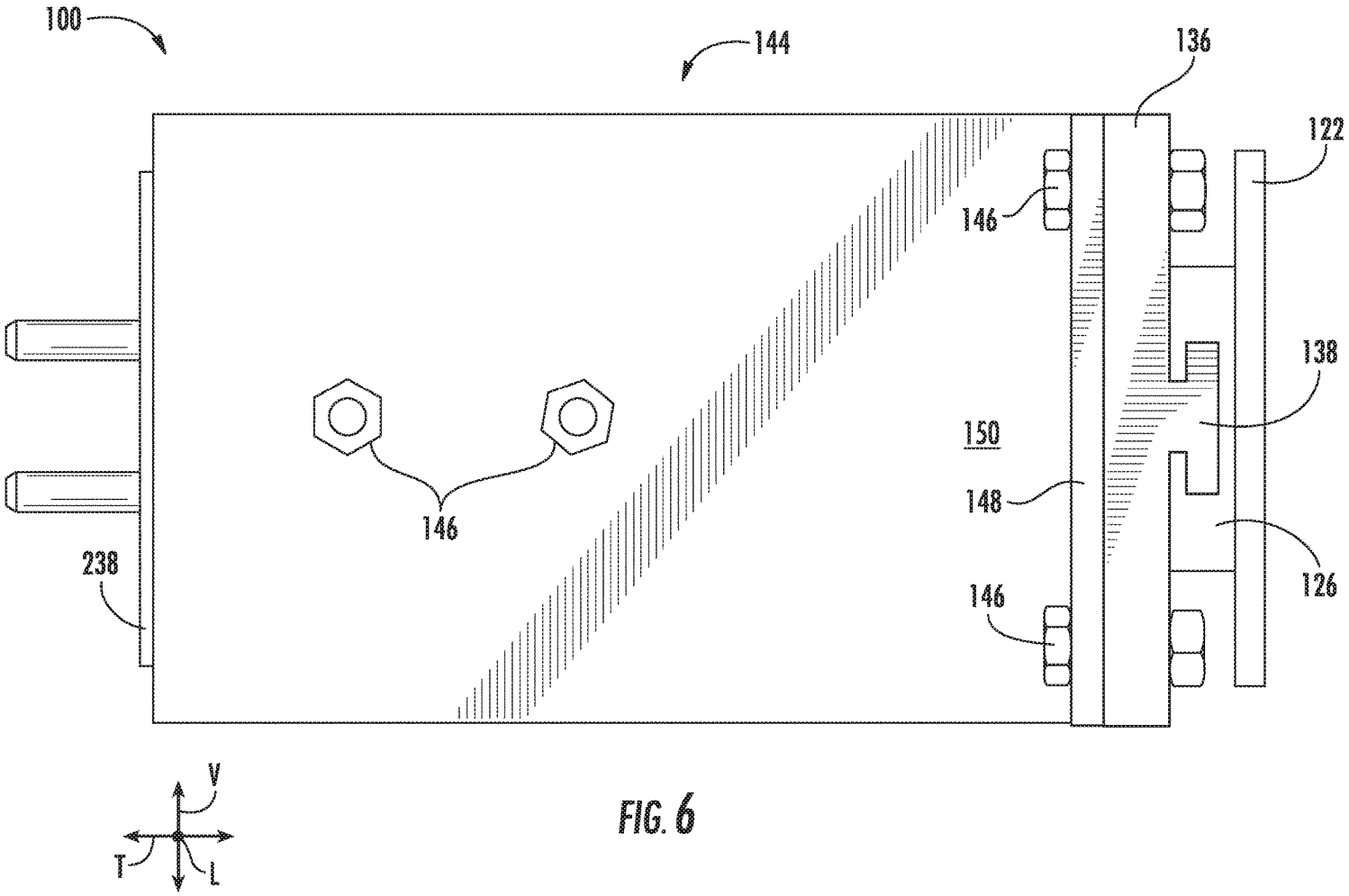
FIG. 6 provides a right, side elevation view of the furnace assembly of FIG. 2.
Figure 7:
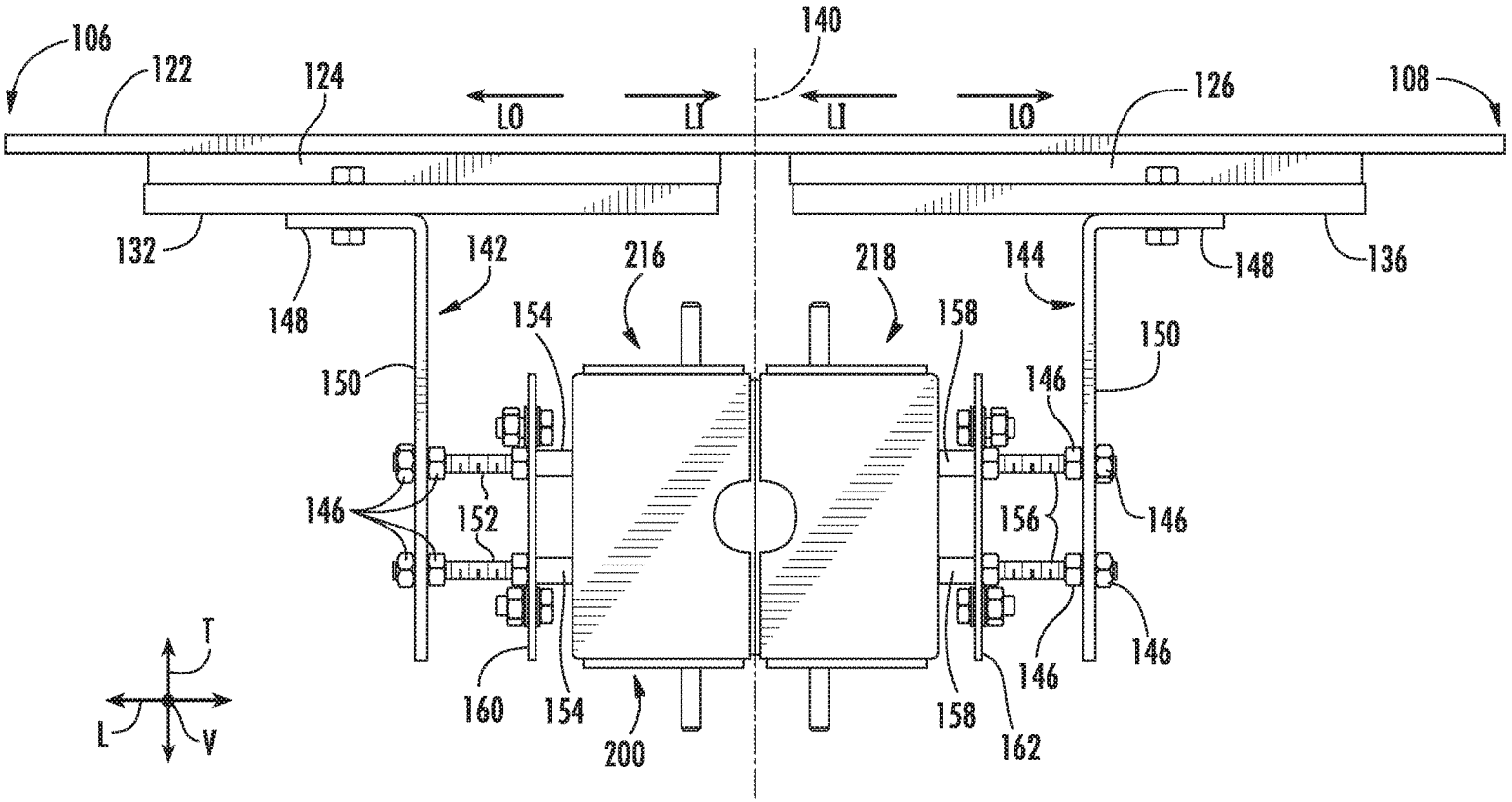
FIG. 7 provides a top plan view of the furnace assembly of FIG. 2.
Figure 8:
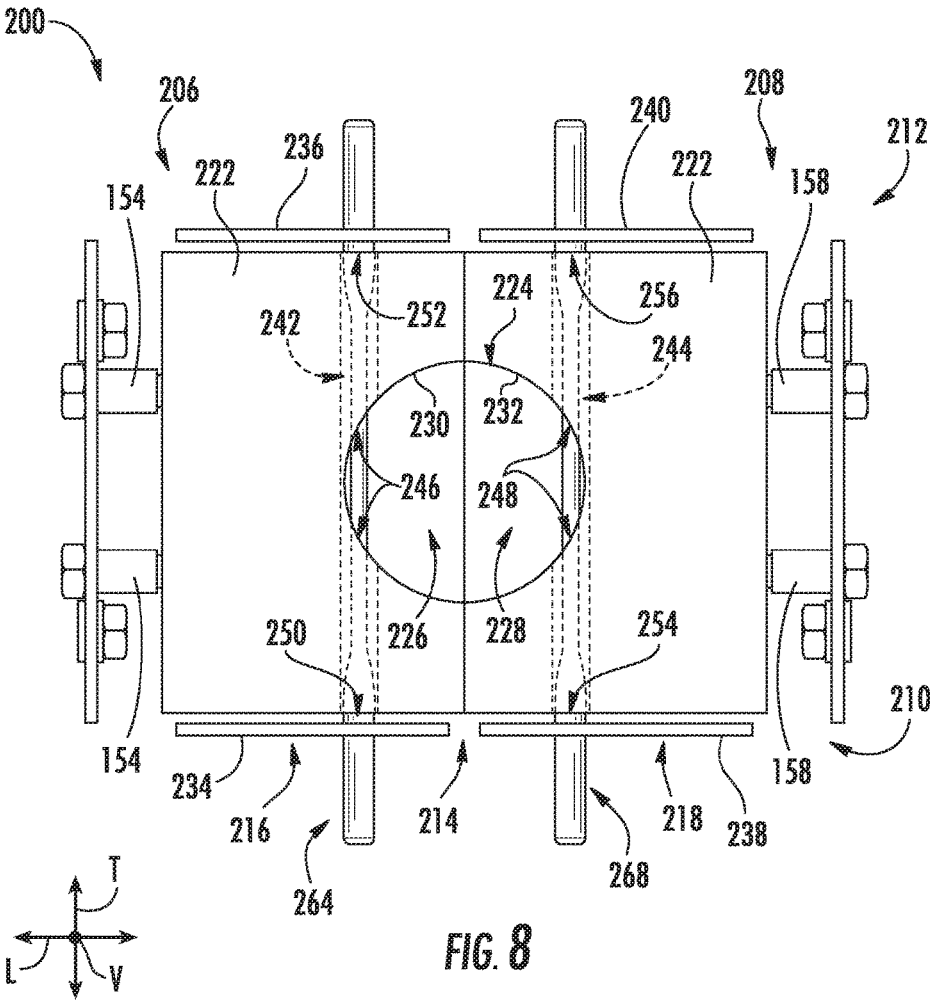
FIG. 8 provides a partial cross-sectional view of the furnace of FIG. 2.
Figure 9:
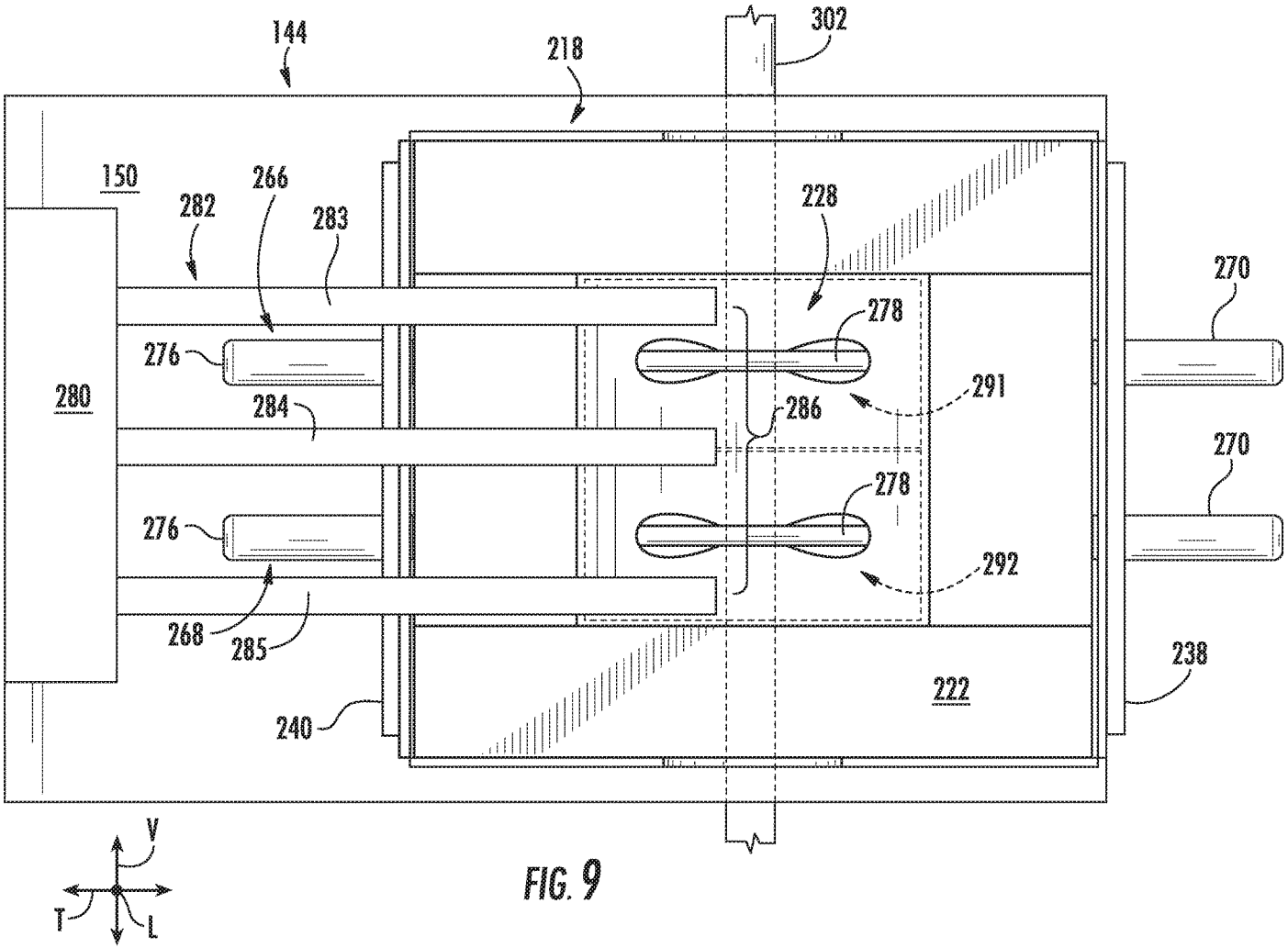
FIG. 9 provides a side elevation view of one shell compartment of the furnace assembly of FIG. 2.
Figure 10:
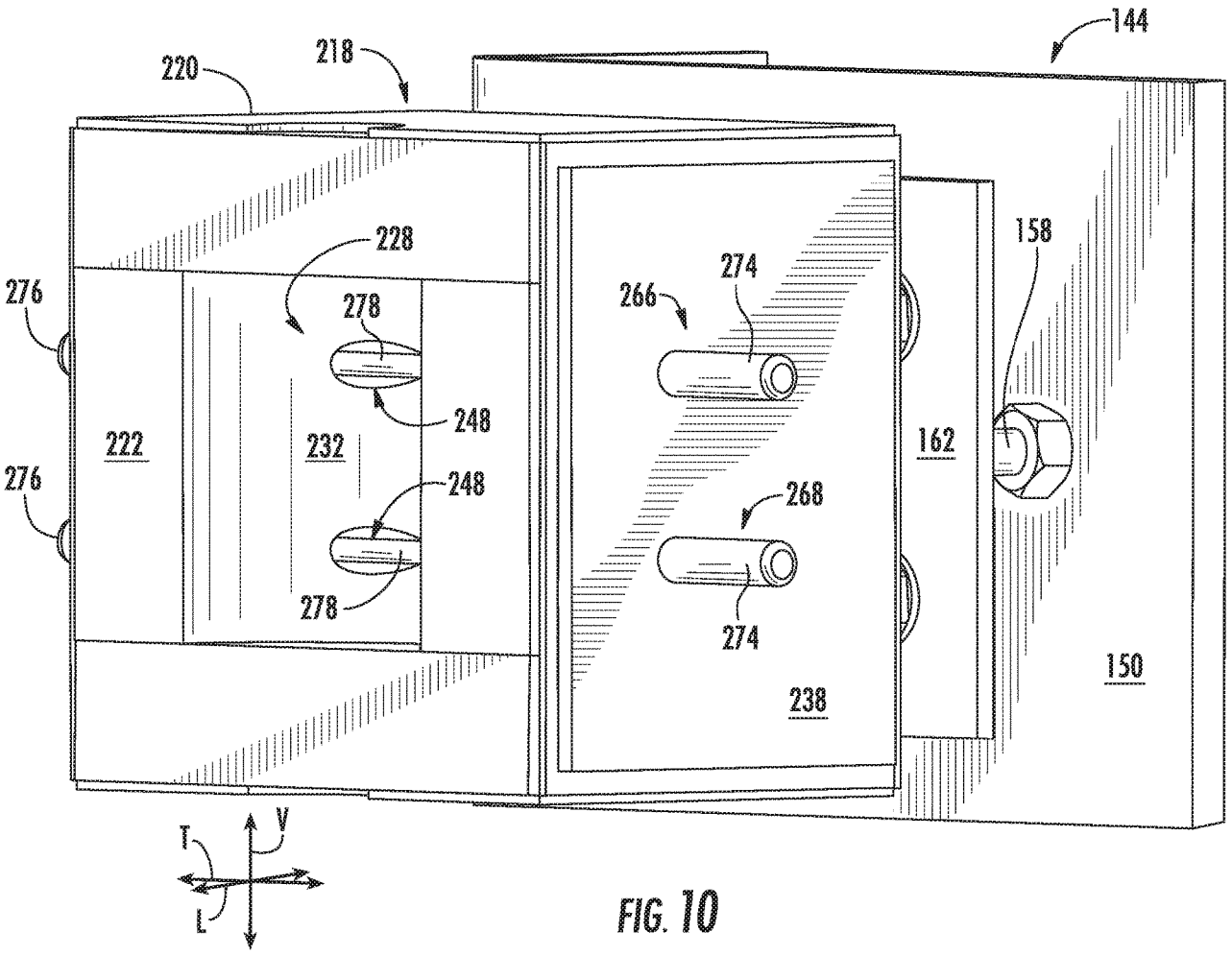
FIG. 10 provides a perspective view of one shell compartment of the furnace assembly of FIG. 2.

An exemplary embodiment of furnace assembly 100 will now herein be described with reference to FIGS. 2 through 10. More particularly, FIGS. 2 and 3 provide front perspective views of furnace assembly 100; FIGS. 4 and 5 provide front elevation views thereof; FIG. 6 provides a right, side elevation view thereof; FIG. 7 provides a top plan view thereof; FIG. 8 provides a partial cross-sectional view of furnace 200; FIG. 9 provides a side elevation view of furnace 200; and FIG. 10 provides a perspective view of a portion of furnace 200 according to an exemplary embodiment of the present disclosure.

As shown in FIG. 2, furnace assembly 100 extends between a top portion 102 and a bottom portion 104 along a vertical direction V. Furnace assembly 100 also extends between a first side 106 and a second side 108 along a lateral direction L and between a front portion 110 and a back portion 112 along a transverse direction T. Vertical direction V, lateral direction L, and transverse direction T are mutually perpendicular and form an orthogonal direction system.

Furnace assembly 100 includes high temperature furnace 200 and a carriage assembly 120 for supporting furnace 200. Carriage assembly 120 includes a fixture bracket 122 that structurally supports furnace assembly 100. Fixture bracket 122 can be mounted or attached to any suitable structure for supporting furnace assembly 100. Fixture bracket 122 extends in a plane parallel to the lateral and vertical directions L, V as shown.

As illustrated in FIGS. 3 and 5, attached to fixture bracket 122 is a first rail bracket 124 and a second rail bracket 126. Both first and second rail brackets 124, 126 extend generally in a plane parallel to the lateral and vertical directions L, V and have a thickness along the transverse direction T. As shown in FIG. 5, first rail bracket 124 is positioned generally between first end 106 of furnace assembly 100 and a lateral centerline 140 defined by furnace assembly 100 and second rail bracket 126 is positioned generally between second end 108 of furnace assembly 100 and lateral centerline 140. First rail bracket 124 defines a track or first groove 128 and second rail bracket 126 defines a track or second groove 130 (FIG. 5). For this embodiment, first groove 128 and second groove 130 are defined in a t-shape configuration. Moreover, as shown, first and second grooves 128, 130 extend generally along the lateral direction L.

As shown particularly in FIGS. 2 and 3, a first sliding plate 132 is coupled with first rail bracket 124. In particular, first sliding plate 132 includes a first wing 134 that is slidable within the T-shaped first groove 128. First wing 134 or first groove 128 can include any suitable bearing surface or members to facilitate slidable movement within first groove 128. For example, first wing 134 and/or first groove 128 can include ball, roller, or other suitable bearing members. Likewise, a second sliding plate 136 is coupled with second rail bracket 126. Second sliding plate 136 includes a second wing 138 that is slidable within the T-shaped second groove 130 of second rail bracket 126, which may best be seen with reference to FIG. 6. Second wing 138 and/or second groove 130 can also include any suitable bearing surface or members to facilitate slidable movement of second wing 138 within second groove 130. As shown in FIG. 2, first and second wings 134, 138 are both configured in a t-shape or t-shape profile. In this manner, first and second wings 134, 138 are complementary to their respective t-shaped first and second grooves 128, 130.

As first wing 134 is slidable within first groove 128, first sliding plate 132 is consequently movable or slidable along the lateral direction L. Likewise, second sliding plate 136 is slidable or movable along the lateral direction L as well. In particular, as shown more particularly in FIG. 5, first and second sliding plates 132, 136 can be slid laterally inward LI or laterally outward LO along the lateral direction L with respect to lateral centerline 140 defined by furnace assembly 100. For instance, first and second sliding plates 132, 136 can be slid laterally inward LI such that furnace 200 is in a closed position as shown in FIGS. 2 and 4, or first and second sliding plates 132, 136 can be slid laterally outward LO such that furnace 200 is in an open position as shown in FIGS. 1, 3 and 5.

Referring to FIG. 2, carriage assembly 120 also includes a first L-bracket 142 connected to first sliding plate 132 and a second L-bracket 144 connected to second sliding plate 136 via one or more fasteners 146, such as e.g., bolts or screws. Specifically, a lateral portion 148 of first L-bracket 142 is connected to first sliding plate 132. Lateral portion 148 extends in a plane parallel to the lateral and vertical directions L, V and has a thickness in the transverse direction T. A transverse portion 150 of first L-bracket extends from lateral portion 148 along a plane parallel to the transverse and vertical directions T, V, thereby forming an L-shape. Transverse portion 150 of first L-bracket 142 has a thickness extending along the lateral direction L. As further shown in FIG. 2, second L-bracket 144 is configured in the same or similar manner as that of first L-bracket 144.

As shown in FIG. 7, two first threaded rods 152 are connected to first L-bracket 142 and extend generally along the lateral direction L. First threaded rods 152 can be made of any suitable material, such as e.g., stainless steel. Each first threaded rod 152 can be fastened to transverse portion 150 of first L-bracket 142 by one or more fasteners 146, such as e.g., one or more nuts. Each first threaded rod 152 is received within a first collar 154 that is attached or connected to furnace 200. For example, first collars 154 can be welded to a side of furnace 200. To receive first threaded rods 152, first collars 154 include internal threading complementary to the threading of first threaded rods 152. By applying torque to one or both of first threaded rods 152, a first shell compartment 216 of furnace 200 can be adjusted along the lateral direction L. Stated alternatively, first shell compartment 216 can be adjusted laterally inward LI or laterally outward LO with respect to lateral centerline 140 by adjusting first threaded rods 152. It will be appreciated that the angle of first shell compartment 216 can be adjusted with respect to the transverse direction T by adjusting one of first threaded rods 152 or by adjusting one first threaded rod 152 more than the other.

Likewise, two second threaded rods 156 are connected to second L-bracket 144 and extend along the lateral direction L. Each second threaded rod 156 can be fastened to second L-bracket 144 by one or more fasteners 146. Each second threaded rod 156 is received within a second collar 158 that is attached or connected to furnace 200. For example, second collars 158 can be welded to a side of furnace 200. To receive second threaded rods 156, second collars 158 include internal threading complementary to the threading of second threaded rods 156. By applying torque to one or both of second threaded rods 156, a second shell compartment 218 of furnace 200 can be adjusted along the lateral direction L. Stated differently, second shell compartment 218 can be adjusted laterally inward LI or laterally outward LO with respect to lateral centerline 140 by adjusting second threaded rods 156. It will be appreciated that the angle of second shell compartment 218 can be adjusted with respect to the transverse direction T by adjusting one of second threaded rods 156 or by adjusting one second threaded rod 156 more than the other.

As further shown in FIG. 7, a first support plate 160 extends in a plane parallel to the transverse and vertical directions T, V and is positioned between transverse portion 150 of first L-bracket 142 and first shell compartment 216 of furnace 200. First support plate 160 can be made of any suitable material. For this embodiment, first support plate 160 is made of an insulating material, and more particularly, first support plate 160 is made of alumina ($AL_2O_3$). In the event cables 201 are run proximate first support plate 160 (FIG. 1), the insulating material of first support plate 160 assists in prevention of unwanted current flow to the plate. In a similar fashion to first support plate 160, a second support plate 162 extends in a plane parallel to the transverse and vertical directions T, V and is positioned between transverse portion 150 of second L-bracket 144 and second shell compartment 218 of furnace 200. Second support plate 162 can be formed using the same materials and can be configured in the same or similar manner as that of first support plate 160. One or more fasteners 146 can be used to couple or secure first support plate 160 with first threaded rods 152 and/or first collars 154 and one or more fasteners 146 can be used to couple or secure first support plate 160 with second threaded rods 156 and/or second collars 158.

As shown in FIG. 4, both first and second support plates 160, 162 include mounting assemblies 164 that can be used to secure one or more cable brackets (FIG. 1) to first and second support plates 160, 162. As shown, mounting assemblies 164 can each include a bolt, one or more washers, and one or more nuts. It will be appreciated that mounting assemblies 164 can include other suitable hardware components for fastening or securing one or more cable brackets to their respective first and second support plates 160, 162.

Furnace 200 will now be described in detail. Generally, as shown in FIG. 2, furnace 200 extends between a top portion 202 and a bottom portion 204 along the vertical direction V, between a first side 206 and a second side 208 along the lateral direction L, and between a front portion 210 and a back portion 212 along the transverse direction T. Furnace 200 utilizes the same orthogonal direction system as that of furnace assembly 100.

Referring still to FIG. 2, as noted previously, furnace 200 includes a shell 214. For this embodiment, shell 214 is formed by first shell compartment 216 and second shell compartment 218 when furnace 200 is in a closed position, as shown in FIGS. 2, 4, and 7. By adjusting carriage assembly 120, first and second shell compartments 216, 218 can be moved laterally inward LI to the closed position for heating specimens or laterally outward LO to the open position (FIGS. 1, 3, 5) when furnace 200 is not in operation. For example, one or both of first and second shell compartments 216, 218 can be moved laterally outward LO to the open position when an operator is inserting a new specimen into place to be heated by furnace 200.

As shown in FIGS. 3 and 10, each shell compartment 216, 218 of shell 214 includes an outer structure or casing 220 and an inner insulation layer 222. Outer casing 220 provides support and rigidity to furnace 200 and inner insulation layer 222 provides an insulating layer of furnace 200. Inner insulation layer 222 can be formed of any suitable insulating material. For this embodiment, inner insulation layer 222 is formed of alumina.

Furnace 200 also includes a plurality of mounting brackets positioned at front and back portions 210, 212 of furnace 200. In particular, as shown in FIG. 8, furnace 200 includes a first front mounting bracket 234 positioned proximate front portion 210 and first end 206 of furnace 200, a first back mounting bracket 236 positioned proximate back portion 212 and first end 206 of furnace 200, a second front mounting bracket 238 positioned proximate front portion 210 and second end 208 of furnace 200, and a second back mounting bracket 240 positioned proximate back portion 212 and second end 208 of furnace 200. Each mounting bracket 234, 236, 238, 240 can be made of any suitable material. For this embodiment, each mounting bracket 234, 236, 238, 240 is formed of an insulating alumina material. In this way, when cables 201 are attached to the heating elements of furnace 200 (FIG. 1), unwanted current does not flow and contact outer casing 220 of shell 214.

As further shown in FIG. 8, shell 214, and more particularly inner insulation layer 222, defines a heating chamber 224. In particular, a first chamber portion 226 is defined by inner insulation layer 222 of first shell compartment 216 and a second chamber portion 228 is defined by inner insulation layer 222 of second shell compartment 218, and when furnace 200 is in the closed position, first chamber portion 226 and second chamber portion 228 come together to form heating chamber 224. For this embodiment, as shown best by FIGS. 3, 8, 9, and 10, heating chamber 224 is defined by inner insulating layer 222 in a generally cylindrical shape. The cylindrical shape of inner insulation layer 222 is defined by a first cylindrical wall 230 in first shell compartment 216 and by a second cylindrical wall 232 in second shell compartment 218. The cylindrical shape can provide for better control over the thermal gradient of furnace 200 during operation. It will be appreciated that inner insulating layer 222 can define heating chamber 224 in other suitable shapes or configurations, such as e.g., a cubed shape.

Heating chamber 224 can have a diameter D1 as shown in FIG. 8, which is the distance across heating chamber 224. For this embodiment, diameter D1 is about one (1) inch. In such an embodiment, the relatively small diameter D1 of heating chamber 224 can provide for a more controlled thermal gradient of the temperature profile within heating chamber 224. In some embodiments, diameter D1 can be equal to or less than one (1) inch. In yet other embodiments, diameter D1 can be greater than one (1) inch. In some embodiments, diameter D1 is less than about two (2) inches. In yet other embodiments, diameter D1 is equal to or greater than two (2) inches.

Referring still to FIG. 8, inner insulation layer 222 of first shell compartment 216 defines first tubular channels 242 (only one shown in FIG. 8) that extend along the transverse direction T while inner insulation layer 222 of second shell compartment 218 defines second tubular channels 244 (only one shown in FIG. 8) that extend along the transverse direction T. First and second tubular channels 242, 244 are positioned along the lateral direction L such that first tubular channels 242 extend at least partially through first chamber portion 226 and second tubular channels 244 extend at least partially through second chamber portion 228. As such, first cylindrical sidewall 230 defines first openings 246 and second cylindrical sidewall 232 defines second openings 248. In addition, a front wall of inner insulation layer 222 of first shell compartment 216 defines a first front opening 250 and a rear wall of inner insulation layer 222 of first shell compartment 216 defines a first back opening 252. In a similar fashion, a front wall of inner insulation layer 222 of second shell compartment 218 defines a second front opening 254 and a rear wall of inner insulation layer 222 of second shell compartment 218 defines a second back opening 256.

First and second tubular channels 242, 244 are each configured to receive one of the heating elements of furnace 200. For first shell compartment 216, as shown in FIG. 8, a heating element may extend along the transverse direction T through first front opening 250, through one of first openings 246 and into first chamber portion 226 of heating chamber 224 such that the heating element extends at least partially through heating chamber 224, and then through the other first opening 246, and finally, through first back opening 252 and out of first shell compartment 216. As shown, the transverse length of the heating element is greater than the length of shell 214. In this manner, a portion of each heating element can be used for mounting cables 201 (FIG. 1) or other components, such as e.g., mounting brackets. In a similar fashion, a heating element may extend along the transverse direction T through second front opening 254, through one of second openings 248 and into second chamber portion 228 of heating chamber 224 such that the heating element extends at least partially through heating chamber 224, and then through the other second opening 248, and finally through second back opening 256 and out of second shell compartment 218.

As shown in FIGS. 3, 4, and 8, furnace 200 includes a plurality of heating elements 260 each extending at least partially through heating chamber 224. In particular, furnace 200 includes a first top heating element 262, a first bottom heating element 264, a second top heating element 266, and a second bottom heating element 268. First top heating element 262 extends through one first tubular channel 242 of first shell compartment 216 and first bottom heating element 264 extends through another first tubular channel 242 (FIG. 8). Second top heating element 266 extends through one second tubular channel 244 of second shell compartment 218 and first bottom heating element 264 extends through another second tubular channel 244 (FIG. 8).

Accordingly, first top heating element 262 is spaced apart from second top heating element 266 along the lateral direction L. First bottom heating element 264 is spaced apart from second bottom heating element 268 along the lateral direction L. The first and second top heating elements 262, 266 are spaced apart from the first and second bottom heating elements 264, 268 along the vertical direction V. Moreover, for this embodiment, first top heating element 262 and first bottom heating element 264 extend in a plane substantially parallel to the transverse and vertical directions T, V and second top heating element 266 and second bottom heating element 268 extend in a plane substantially parallel to the transverse and vertical directions T, V. As such, first top heating element 262 and first bottom heating element 264 are spaced apart from second top heating element 266 and second bottom heating element 268 along the lateral direction L.

In some embodiments, first top heating element 262 and first bottom heating element 264 may both extend along the transverse direction T and can extend along the transverse direction T in different vertical planes. Stated alternatively, first top heating element 262 and first bottom heating element 264 may be spaced apart along the lateral direction L from one another. Likewise, in some embodiments, second top heating element 266 and second bottom heating element 268 may both extend along the transverse direction T and can extend along the transverse direction T in different vertical planes. Stated alternatively, second top heating element 266 and second bottom heating element 268 may be spaced apart along the lateral direction L from one another. In yet other embodiments, first top heating element 262 can extend in a different plane along the lateral direction L than second top heating element 266. In yet further embodiments, first bottom heating element 264 can extend in a different plane along the lateral direction L than second bottom heating element 268.

Figure 11:
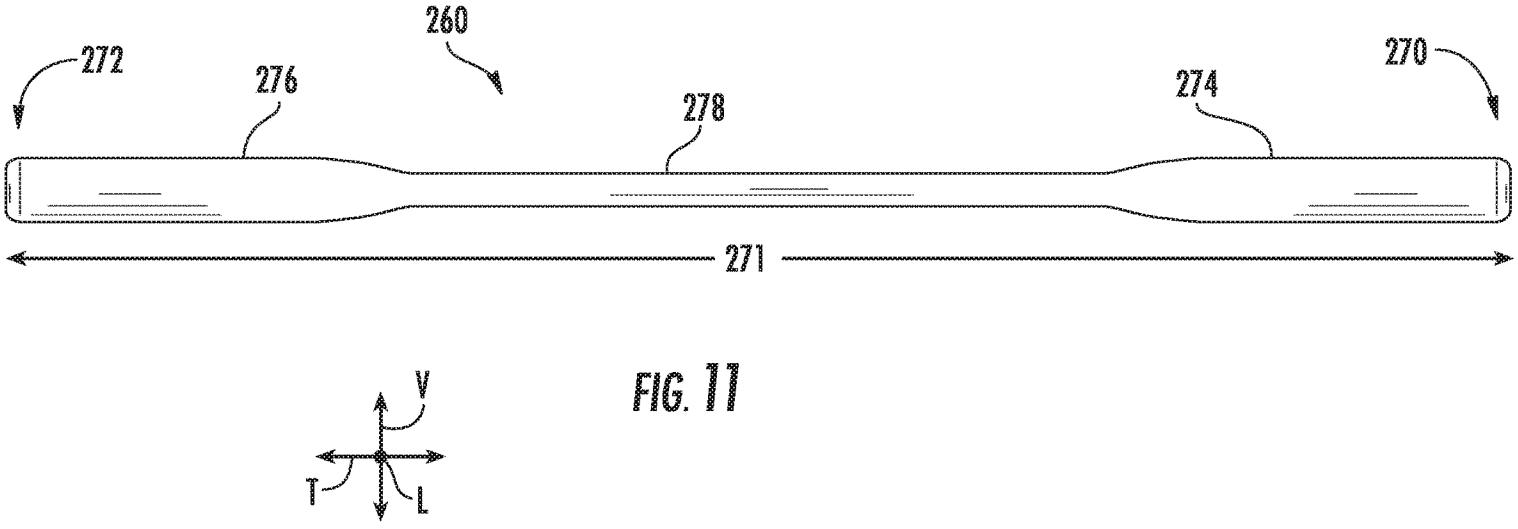
FIG. 11 provides a side elevation view of an exemplary heating element according an exemplary embodiment of the present disclosure.

FIG. 11 provides a side elevation view of an exemplary heating element 260 according an exemplary embodiment of the present disclosure. It will be appreciated that each heating element 262, 264, 266, 268 of furnace 200 can be configured in the same or similar manner as that of heating element 260 shown in FIG. 11 and described in the accompanying text. As shown, for this embodiment, heating element 260 is rod-shaped. More particularly, for this embodiment, heating element 260 is shaped in an hourglass configuration along its transverse length 271 (i.e., the length of heating element 260 along the transverse direction T). The rod-liked shape of heating element 260 offers a more streamlined shape, as opposed to a u-shaped heating element, for example. With streamlined heating elements 260, furnace 200 can also be more streamlined or less bulky.

Heating element 260 extends along the transverse direction T between a front 270 and a back 272. Positioned proximate front 270 is a front portion 274 of heating element 260 and positioned proximate back 272 is a back portion 276 of heating element 260. Back portion 276 is positioned opposite front portion 274. Extending between front portion 274 and back portion 276 is a shank portion 278, which is the portion of heating element 260 that extends through heating chamber 224 (FIG. 9). For this embodiment, front portion 274 and back portion 276 have larger diameters than shank portion 278. As one example, front and rear portions 274, 276 can each have a diameter of six (6) mm and shank portion 278 can have a diameter of three (3) mm. As another example, front and rear portions 274, 276 can each have a diameter of nine (9) mm and shank portion 278 can have a diameter of four (4) mm. As yet another example, front and rear portions 274, 276 can each have a diameter of twelve (12) mm and shank portion 278 can have a diameter of six (6) mm. It will be appreciated that front and rear portions 274, 276 and shank portion 278 can be other suitable sizes. The smaller diameter of shank portion 278 can increase the resistive path of the current routed through heating element 260 such that heating element 260 can provide the required heat output. In addition, for this embodiment, heating element 260 is formed of molybdenum disilicide ($MoSi_2$). However, heating element 260 can be formed of any suitable material for use in high temperature furnace 200.

Front and rear portions 274, 276 provide attachment surfaces in which one or more cables 201 can be attached for providing current to furnace 200 (FIG. 1). For ease of attachment, as noted previously, transverse length 271 of each heating element 260 extends a greater distance than the transverse length of shell 214. As a result, front and rear portions 274, 276 are exposed on both the front and back portion sides of shell 214. Thus, heating element 260 is exposed at its front and back portions 274, 276 for attachment of cables 201 (FIG. 1). Front and rear portions 274, 276 can be coated with aluminum or another suitable conducting material for better conductive properties such that a power source and furnace 200 can be in electrical communication, such as e.g., via one or more cables 201.

Figure 12:
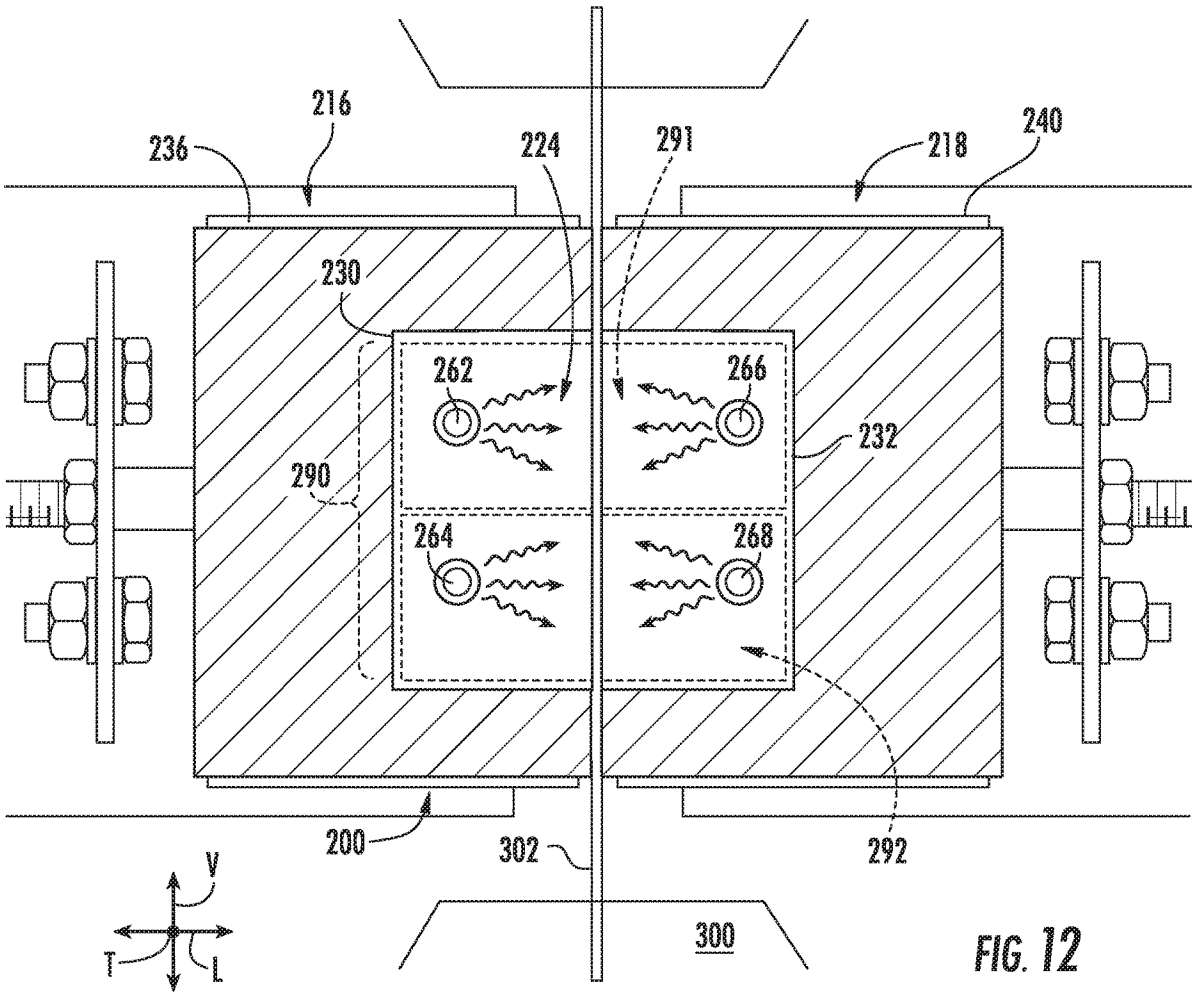
FIG. 12 provides a front, partial cross-sectional view of an exemplary furnace depicting various heating zones according to an exemplary embodiment of the present disclosure.

Utilizing heating elements 260, furnace 200 can heat a specimen with multiple heating zones 290. FIG. 12 provides a front, partial cross-sectional view of one exemplary embodiment of furnace 200 depicting various heating zones 290 delineated by the dashed lines. As shown in FIG. 12, heating chamber 224 of furnace 200 can include multiple heating zones 290. To achieve multiple heating zones 290, for this embodiment, first and second top heating elements 262, 266 are in electrical communication with one another in series and thus provide the same or substantially the same heat output. In a similar fashion, first and second bottom heating elements 264, 268 are in electrical communication with one another in series and thus provide the same or substantially the same heat output. Accordingly, when first and second top heating elements 262, 266 radiate heat during operation of furnace 200, first and second top heating elements 262, 266 define a first heating zone 291. Moreover, when first and second bottom heating elements 264, 268 radiate heat during operation of furnace 200, first and second bottom heating elements 264, 268 define a second heating zone 292. As shown, for this embodiment, first heating zone 291 is positioned generally above second heating zone 292 along the vertical direction V.

Figure 13:
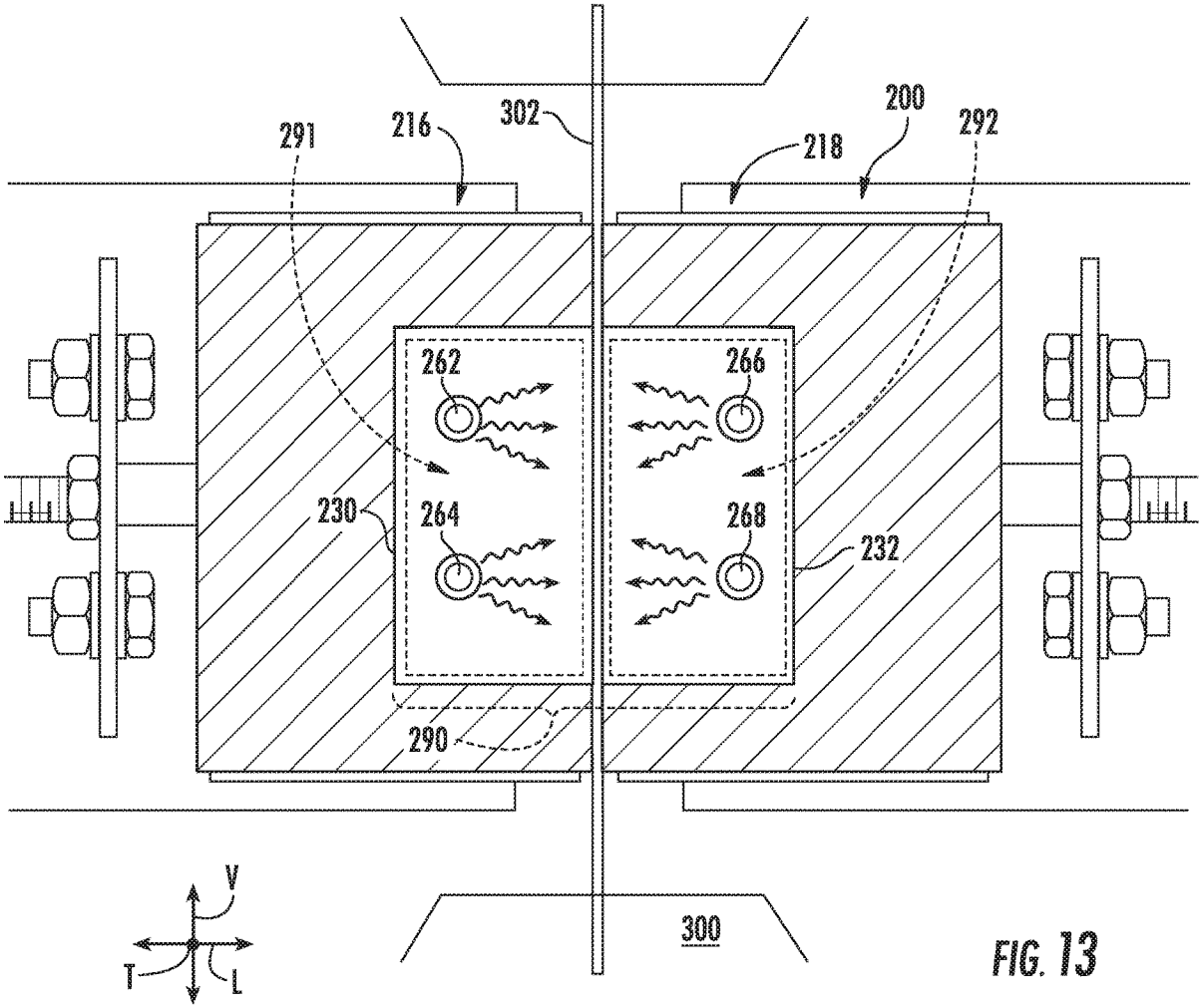
FIG. 13 provides another front, partial cross-sectional view of an exemplary furnace depicting various heating zones according to an exemplary embodiment of the present disclosure.

FIG. 13 provides a front, partial cross-sectional view of another exemplary embodiment of furnace 200 depicting various heating zones 290. As shown in FIG. 13, heating chamber 224 of furnace 200 can include multiple heating zones 290. To achieve multiple heating zones 290, for this embodiment, first top and bottom heating elements 262, 264 are in electrical communication with one another in series and thus provide the same or substantially the same heat output. In a similar fashion, second top and bottom heating elements 266, 268 are in electrical communication with one another in series and thus provide the same or substantially the same heat output. Accordingly, when first top and bottom heating elements 262, 264 radiate heat during operation as shown, first top and bottom heating elements 262, 264 define a first heating zone 291. Moreover, when second top and bottom heating elements 266, 268 radiate heat during operation, second top and bottom heating elements 266, 268 define a second heating zone 292. For this embodiment, first heating zone 291 is positioned generally adjacent second heating zone 292 along the lateral direction L.

Figure 14:
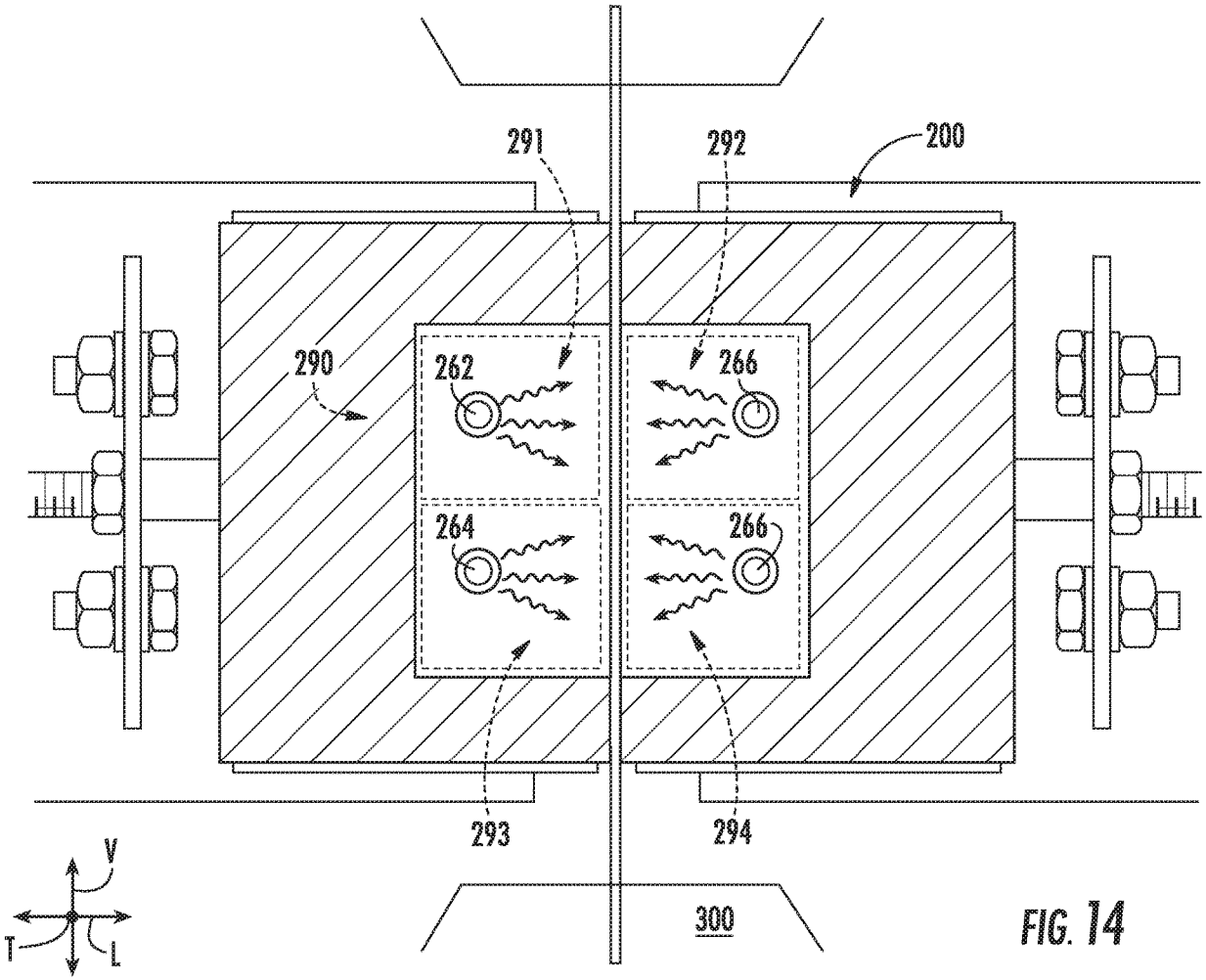
FIG. 14 provides yet another front, partial cross-sectional view of an exemplary furnace depicting various heating zones according to an exemplary embodiment of the present disclosure.

FIG. 14 provides a front, partial cross-sectional view of yet another exemplary embodiment of furnace 200 depicting various heating zones 290. As shown in FIG. 14, heating chamber 224 of furnace 200 can include multiple heating zones 290. To achieve multiple heating zones 290, for this embodiment, each heating element 260 is controlled independently by controller 280 and can provide a temperature output independent of the other heating elements 260. Accordingly, when first top heating element 262 radiates heat, first top heating element 262 defines first heating zone 291. When second top heating element 266 radiates heat, second top heating element 266 defines second heating zone 292. When first bottom heating element 264 radiates heat, first bottom heating element 264 defines a third heating zone 293. When second bottom heating element 268 radiates heat, second bottom heating element 268 defines a fourth heating zone 294. As shown, for this embodiment, first heating zone 291 is positioned generally above third heating zone 293 along the vertical direction V and adjacent second heating zone 292 along the lateral direction L. Second heating zone 292 is positioned generally above fourth heating zone 294 along the vertical direction V and adjacent first heating zone 291 along the lateral direction L. Third heating zone 293 is positioned generally below first heating zone 291 along the vertical direction V and adjacent fourth heating zone 294 along the lateral direction L. Fourth heating zone 294 is positioned generally below second heating zone 292 along the vertical direction V and adjacent third heating zone 293 along the lateral direction L.

In some embodiments, exemplary furnace 200 can include more than four heating elements 260, or in some embodiments, less than four heating elements 260. In such embodiments, it will be appreciated that the heating elements 260 of furnace 200 can define any suitable number of heating zones 290.

Returning to FIG. 9, second shell compartment 218 of shell 214 is provided. First shell compartment 216 has been removed for clarity. As shown in FIG. 9, a controller 280 is provided for controlling operation of furnace 200. For this embodiment, controller 280 includes one or more processors and one or more memory devices. Processors can be any suitable type of processing device (e.g., any combination of general or special purpose processors, CPUs, a processor core, a microprocessor, an ASIC, a FPGA, a microcontroller, etc.) and can be one processor or a plurality of processors that are operatively connected. Additionally or alternatively, controller 280 may be constructed without using a processor, e.g., using a combination of discrete analog and/or digital logic circuitry (such as switches, amplifiers, integrators, comparators, flip-flops, AND gates, and the like) to perform control functionality instead of relying upon software. Memory device can include one or more non-transitory computer-readable storage mediums, such as RAM, ROM, EEPROM, EPROM, flash memory devices, magnetic disks, etc., and/or combinations thereof. Memory device may be a separate component from processor or may be included onboard within processor. Memory devices can store data and instructions that are executed by processor to cause controller 280 to perform operations. For example, instructions can include instructions for providing a certain amount of current to one or more of the heating elements 262, 264, 266, 268 based at least in part on one more signals received by controller 180, such as e.g. one or more signals received from a user input.

Extending from controller 280 are sheathed thermocouples 282 for sensing or measuring the temperature within heating chamber 224. For this embodiment, furnace 200 includes a top thermocouple 283, a bottom thermocouple 284, and a middle thermocouple 285 positioned between top and bottom thermocouples 283, 285 along the vertical direction V. Top, middle, and bottom thermocouples 283, 284, 285 measure the temperature within heating chamber 224 proximate their respective locations. Specimen 302, which for this embodiment is a CMC specimen, is shown extending through furnace 200 between first shell compartment 216 and second shell compartment 218 (specimen 302 is shown transparent for clarity). A gauge section 286 is defined between top thermocouple 283 and bottom thermocouple 285 within the volume of heating chamber 224. In some embodiments, furnace 200 can provide a thermal gradient or profile within gauge section 286 within a predetermined temperature variance. As an example, in some embodiments, furnace 200 can provide a thermal gradient or profile within gauge section 286 within 15° F. of the set point temperature, including set point temperatures at or exceeding 2700° F. As another example, in some embodiments, furnace 200 can provide a thermal gradient or profile within gauge section 286 within 10° F. of the set point temperature, including set point temperatures at or exceeding 2700° F. As yet another example, in some embodiments, furnace 200 can provide a thermal gradient or profile within gauge section 286 within 5° F. of the set point temperature, including set point temperatures at or exceeding 2700° F. As exemplary furnace 200 has multiple zone heating capability, which for this embodiment is first heating zone 291 and second heating zone 292 positioned below first heating zone 293 along the vertical direction V, furnace 200 can better maintain the thermal gradient along gauge section 286.

Moreover, as noted above, in some embodiments, as exemplary furnace 200 can heat a specimen using multiple heating zones 290, less current is required to pass through heating elements 262, 264, 266, 268 to provide heat to heating chamber 224 to a desired or predetermined temperature or to achieve a desired output. In this way, energy consumption can be reduced. In some embodiments, for example, furnace 200 can achieve and maintain high temperatures (i.e., temperatures above 2400° F.) with a required current of equal to or less than seventy-five amperes (75 amps). In some embodiments, furnace 200 can achieve and maintain temperatures at or above 2700° F. with a required current of equal to or less than seventy-five amperes (75 amps).

Figure 15:
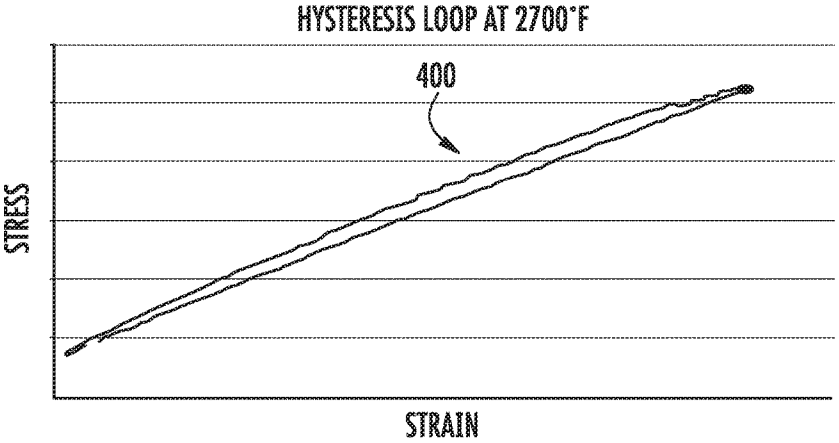
FIG. 15 provides a stress-strain plot depicting a hysteresis loop for an exemplary specimen undergoing strain controlled fatigue testing at 2700° F. utilizing exemplary furnace.
Figure 16:
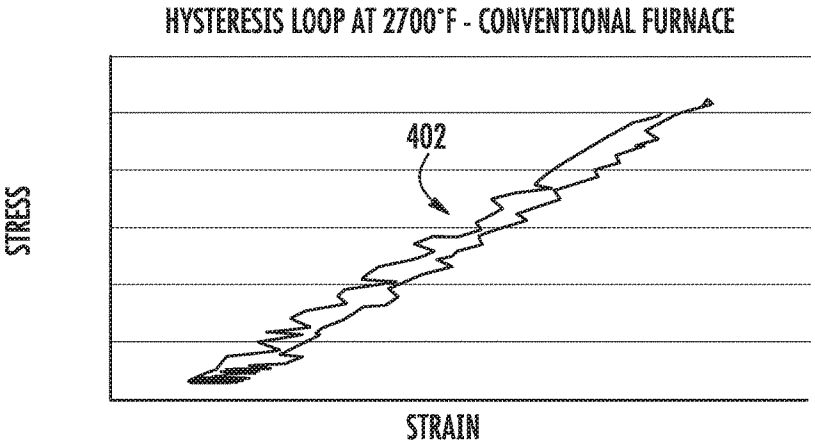
FIG. 16 (PRIOR ART)
FIG. 16 provides a stress-strain plot depicting a hysteresis loop for an exemplary specimen undergoing strain controlled fatigue testing at 2700° F. utilizing a conventional prior art furnace.

In addition, the reduction in required current also advantageously reduces the amount of noise affecting the instruments, sensors, and other data collection devices positioned proximate furnace 200 for monitoring specimen 302 during testing. By way of example, FIG. 15 provides a stress-strain plot depicting a hysteresis loop 400 for an exemplary specimen undergoing strain controlled fatigue testing at 2700° F. utilizing one of the exemplary furnaces 200 of the present disclosure. FIG. 16 provides a stress-strain plot depicting a hysteresis loop 402 for exemplary specimen undergoing strain controlled fatigue testing at 2700° F. utilizing a conventional furnace of the prior art. As shown in FIG. 16, the conventional furnace stress-strain hysteresis loop 402 shows excess noise in the strain signal. This is due in part because the conventional furnace requires a certain amount of current to achieve the desired heat output temperature of 2700° F. In comparison, as shown in FIG. 15, the stress-strain hysteresis loop 400 for the specimen tested using exemplary furnace 200 shows little strain signal noise. This is due in part because of the multiple heating zone capability of furnace 200. Because furnace 200 has heating elements 260 that provide furnace 200 with multiple heating zone capability, less current is needed to flow through the circuits to provide the required output to heat the specimen to 2700° F. As less current is needed, there is less noise affecting the instruments. Accordingly, more accurate test results can be obtained.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A high temperature furnace defining a vertical direction, a lateral direction, and a transverse direction, the high temperature furnace comprising:

a shell defining a heating chamber; and a plurality of heating elements each extending at least partially through the heating chamber, the plurality of heating elements including a first top heating element, a first bottom heating element, a second top heating element, and a second bottom heating element, the first top heating element spaced apart from the second top heating element along the lateral direction, the first bottom heating element spaced apart from the second bottom heating element along the lateral direction, and the first and second top heating elements spaced apart from the first and second bottom heating elements along the vertical direction;

wherein during operation of the high temperature furnace, the heating elements define at least two heating zones, including a first heating zone and a second heating zone.

2. The high temperature furnace of claim 1, wherein each of the heating elements are rod-shaped.

3. The high temperature furnace of claim 1, wherein each of the heating elements are shaped in an hourglass configuration along a transverse length of each heating element.

4. The high temperature furnace of claim 1, wherein the first and second top heating elements define the first heating zone and the first and second bottom heating elements define the second heating zone.

5. The high temperature furnace of claim 1, wherein the first top and bottom heating elements define the first heating zone and the second top and bottom heating elements define the second heating zone.

6. The high temperature furnace of claim 1, wherein the first top heating element defines the first heating zone, the second top heating element defines the second heating zone, the first bottom heating element defines a third heating zone, and the second bottom heating element defines a fourth heating zone.

7. The high temperature furnace of claim 1, wherein each of the heating elements extend substantially parallel to one another along the transverse direction.

8. The high temperature furnace of claim 1, wherein the first top heating element and the first bottom heating element extend in a plane substantially parallel to the transverse and vertical directions and the second top heating element and the second bottom heating element extend in a plane substantially parallel to the transverse and vertical directions, and wherein the first top heating element and the first bottom heating element are spaced apart from the second top heating element and the second bottom heating element along the lateral direction.

9. The high temperature furnace of claim 1, wherein each of the heating elements are formed of molybdenum disilicide ($MoSi_2$).

10. The high temperature furnace of claim 1, wherein the furnace is capable of maintaining temperatures over 2400° F. within the heating chamber.

11. The high temperature furnace of claim 1, wherein the furnace is capable of maintaining temperatures over 2700° F. within the heating chamber.

12. The high temperature furnace of claim 1, wherein the shell comprises a first shell compartment and a second shell compartment that each are slidable along the lateral direction.

13. A high temperature furnace defining a vertical direction, a lateral direction, and a transverse direction, the high temperature furnace comprising:

a shell defining a heating chamber and having a length extending along the transverse direction between a front portion and a back portion; and a plurality of heating elements each being rod-shaped and extending at least partially through the heating chamber along the transverse direction, each heating element having a transverse length, and wherein the transverse length is greater than the length of the shell;

the plurality of heating elements including a first top heating element, a first bottom heating element, a second top heating element, and a second bottom heating element, the first top heating element spaced apart from the second top heating element along the lateral direction, the first bottom heating element spaced apart from the second bottom heating element along the lateral direction, and the first and second top heating elements spaced apart from the first and second bottom heating elements along the vertical direction;

wherein the heating elements define at least two heating zones, including a first heating zone and a second heating zone.

14. The high temperature furnace of claim 13, wherein the first and second top heating elements define the first heating zone and the first and second bottom heating elements define the second heating zone.

15. The high temperature furnace of claim 13, wherein the first top and bottom heating elements define the first heating zone and the second top and bottom heating elements define the second heating zone.

16. The high temperature furnace of claim 13, wherein the first top heating element defines the first heating zone, the second top heating element defines the second heating zone, the first bottom heating element defines a third heating zone, and the second bottom heating element defines a fourth heating zone.

17. The high temperature furnace of claim 13, wherein each of the heating elements are formed of molybdenum disilicide ($MoSi_2$).

* * * * *